United States Patent [19]

Johansson et al.

[11] Patent Number: 4,548,003

[45] Date of Patent: Oct. 22, 1985

[54] PREFABRICATED BALCONY PLATFORM

[75] Inventors: Kurt Å. Johansson, Strömstad; John-Eric Marcusson, Handen, both of Sweden

[73] Assignee: Alnova Bygg Aktiebolag, Stromstad, Sweden

[21] Appl. No.: 473,330

[22] Filed: Mar. 8, 1983

[30] Foreign Application Priority Data

Mar. 16, 1982 [SE] Sweden ..... 8201641
Dec. 28, 1982 [SE] Sweden ..... 8207434

[51] Int. Cl.[4] ..... E04B 1/34

[52] U.S. Cl. ..... 52/73; 52/707; 52/785

[58] Field of Search ..... 52/64, 66, 69, 73, 235, 52/263, 309.4, 822, 824, 704, 707, 601, 232, 177, 181, 782, 785, 787, 809, 813

[56] References Cited

U.S. PATENT DOCUMENTS

| | | | |
|---|---|---|---|
| 1,328,875 | 1/1920 | Herbert | 52/181 |
| 2,199,586 | 5/1940 | Bowser | 52/809 |
| 2,363,156 | 11/1944 | Sinner et al. | 52/707 |
| 2,715,953 | 8/1955 | Marrow | 52/263 |
| 2,772,560 | 12/1956 | Neptune | 52/707 |
| 3,300,928 | 1/1967 | Keller | 52/824 |
| 3,406,491 | 10/1968 | Harding | 52/787 |
| 3,487,597 | 1/1970 | Gutt | 52/73 |
| 3,782,057 | 1/1974 | Gross | 52/601 |
| 3,832,811 | 9/1974 | Briel | 52/69 |
| 4,011,700 | 3/1977 | Sado | 52/235 |
| 4,069,629 | 1/1978 | Piazza | 52/309.4 |

FOREIGN PATENT DOCUMENTS

| | | |
|---|---|---|
| 2220523 | 11/1972 | Belgium . |
| 1003182 | 1/1977 | Canada . |
| 168698 | 9/1959 | Sweden . |
| 8023/68 | 6/1968 | Sweden . |
| 355833 | 5/1973 | Sweden . |

*Primary Examiner*—James L. Ridgill, Jr.
*Attorney, Agent, or Firm*—Harness, Dickey & Pierce

[57] ABSTRACT

A prefabricated balcony platform including attachment members to fasten the platform to the wall of a building, and apertures to secure a parapet to the platform. The balcony platform consists of a load-carrying beam frame of a corrosion-resistant metal, such as aluminium, a bottom slab of refractory material attached to the lower face of the beam frame and a top slab attached to the upper face of the beam frame and consisting of a material having heat-transfer properties, preferably aluminium. In the beam frame intermediate the two slabs is provided a layer of sound-proof, refractory material, such as mineral wool.

4 Claims, 6 Drawing Figures

PREFABRICATED BALCONY PLATFORM

BACKGROUND OF THE INVENTION

The subject invention concerns a prefabricated balcony platform including attachment members to secure the platform to the wall of the building and apertures for erecting and securing a balcony parapet to the platform.

According to building construction standard specifications, balcony platforms for mult-storey buildings must be constructed and designed to ensure that in the event of a fire they are able to serve as guard screens to prevent the fire from spreading upwards to the storeys above. According to authority regulations balcony platforms therefore must be able to withstand certain temperatures for a predetermined period of time without impairment to their structural strength.

A consequence of this regulation is that almost without exception balcony platforms hitherto have had to be made from reinforced concrete. This material meet the fire protection requirements but suffers from the disadvantage of being comparatively heavy. In addition, one has found that the increasing acidification of the air erodes the concrete and corrodes the reinforcement irons, thus causing serious damages which in time make this type of balcony platforms unsafe to walk on.

Attempts have been made to replace the concrete with other types of material, such as aluminium. However, the melting point of this material is too low to meet the fire protection safety standards. For this reason attempts have been made to use refractory material to screen off load-carrying aluminium components from the effects of heat. However, such constructions become so heavy and expensive that the disadvantages outweigh the advantages of using aluminium.

SUMMARY OF THE INVENTION

The purpose of the subject invention is to make it possible to use aluminium as a constructional material in balcony platforms without making the construction unit too heavy or too expensive to manufacture.

To achieve this purpose the balcony platform in accordance with the invention is characterised in that it comprises a load-supporting beam frame of a corrosion-resistant material, such as aluminium, a bottom slab of refractory material attached to the lower face of the beam frame, a top slab attached to the upper face of the beam frame and consisting of a material having heat-transfer properties, preferably aluminium, and an intermediate layer of sound-proof, refractory material, such as mineral wool, positioned in the beam frame between the top and bottom layers.

Owing to the provision of balcony platform attachment members of a special design in accordance with the invention very efficient transfer of heat is achieved as also efficiency in mounting the balcony platform and securing it to the building wall.

Further characteristics of the invention will appear from the appended claims.

BRIEF DESCRIPTION OF THE DRAWINGS

The invention will be described in closer detail in the following with reference to the accompanying drawings which illustrate some preferred embodiments of the invention. In the drawings.

DETAILED DESCRIPTION OF PREFERRED EMBODIMENTS

Figure 1:
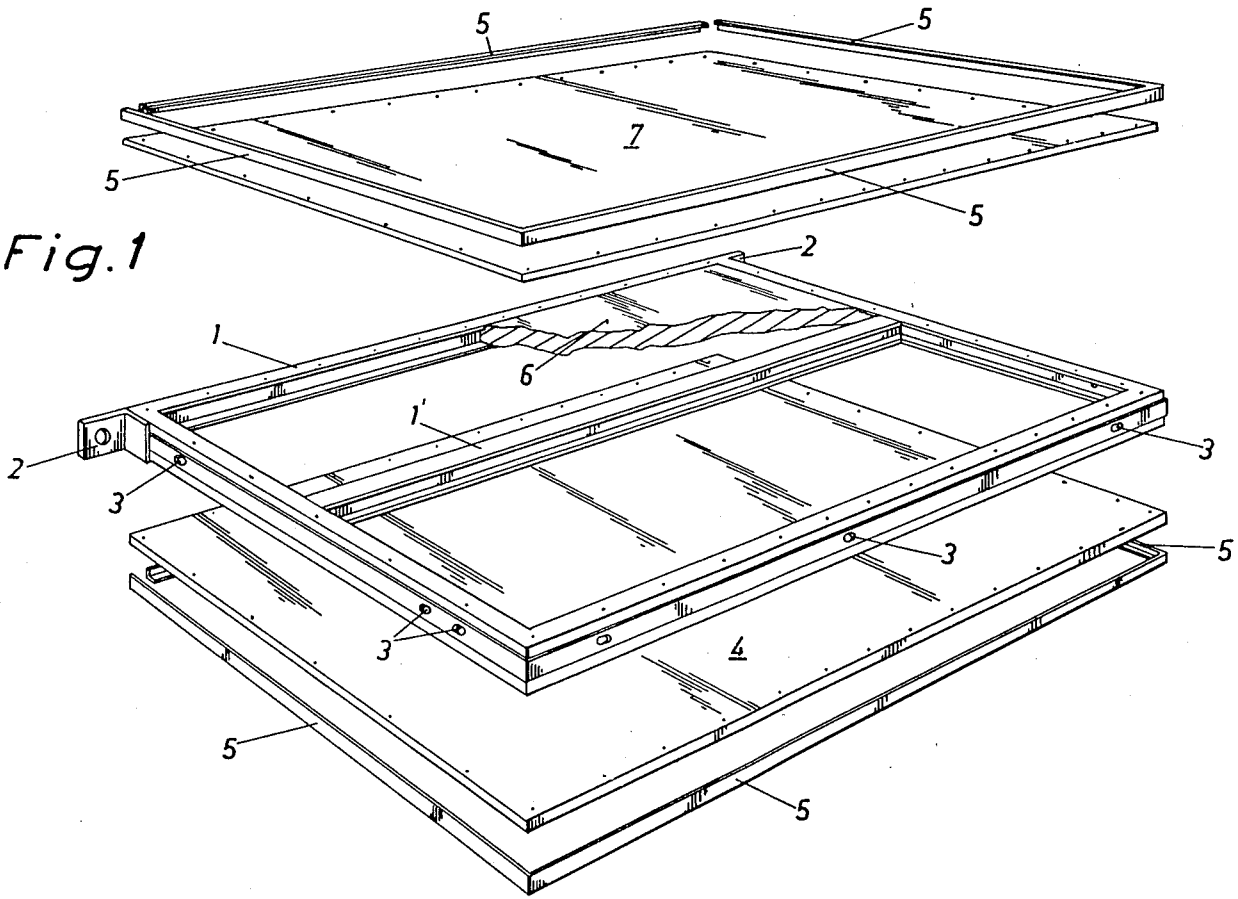
FIG. 1 is a perspective view of the balcony platform in accordance with the invention prior to its assembly.

The balcony platform consists of a beam frame 1 of extruded aluminium profiles and comprising a cross beam 1'. The beam frame 1 is provided with attachment members 2 by means of which the platform may be mounted and secured to the building wall by bolts. The beam frame 1 is also provided with attachment apertures 3 in which a parapet (not shown in FIG. 1) may be secured to the platform and with obliquely extending stays (not illustrated in the drawings). A bottom slab 4 of a refractory material is positioned on the lower face of the beam frame 1 and secured thereto by means of edge ribs 5. The interior of the beam frame is filled with a layer 6 of mineral wool. Onto the upper face of the beam frame 1 is applied a top slab 7 of aluminium, the upper face of the slab preferably being knurled in order to provide a non-slip surface. Also the top slab 2 is secured to the frame with the aid of edge ribs 5.

The balcony platform may be prefabricated in any desired dimensions in the manner just described. Large-size platforms are provided with one or several additional transverse beams 1'. The balcony platform is easy to handle in transport and storage.

Prior to attaching the balcony platform to a building wall the parapet 8 is placed and secured in position on the platform by means of bolts 9 inserted into the attachment apertures 3 formed in the frame 1. The parapet 8 may be used as a gripping means in which hoisting gear may engage to lift the balcony platform to the intended position on the building wall.

Figure 2:
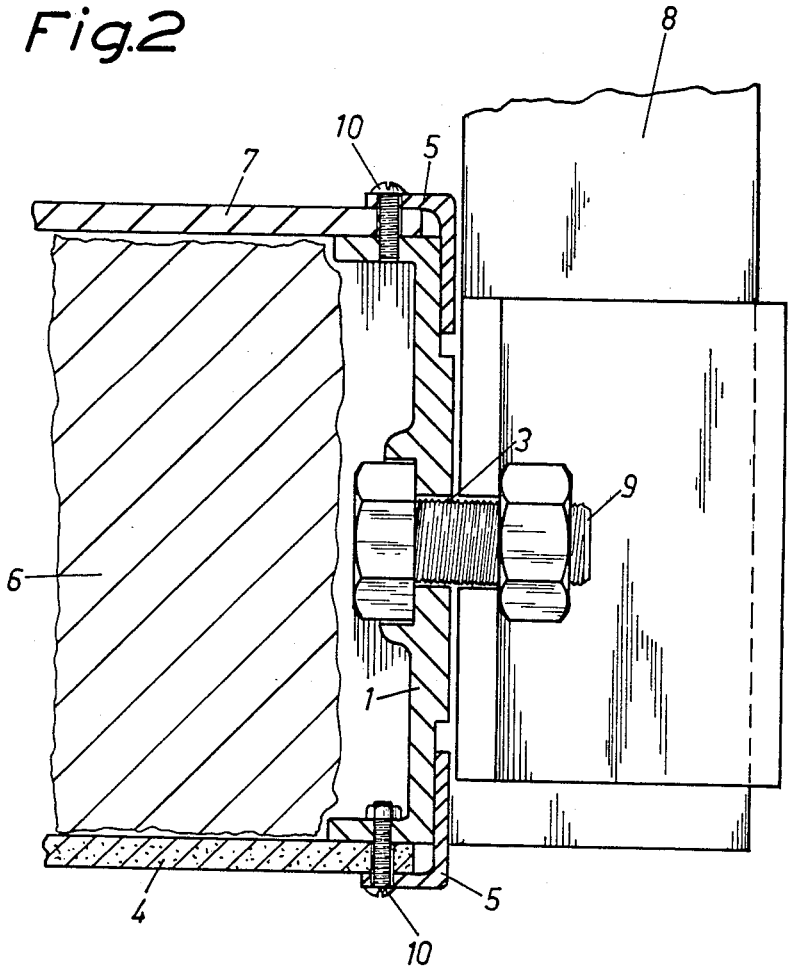
FIG. 2 shows on an enlarged scale a cross-sectional view through the balcony platform in accordance with the invention in assembled position.

FIG. 2 illustrates in a cross-sectional view a portion of the assembled platform with the top and bottom slabs 7 and 4 secured to the frame 1 with the aid of edge ribs 5 and small bolts 10, and with a parapet 8 bolted to the platform as at 9.

In case of serious fires, when flames flaring from one window in an apartment below threaten to spread the fire upwards to the apartment above the balcony platform in accordance with the invention is able to screen off the upper apartment from the effects of the flames. Practical tests have proved the platform to be very efficient in this respect. The refractory slab 4 is unaffected by flames and the heat is conducted and transferred upwards at the edges of the beam frame by the way of direct contact of the frame beams with the slab 4 and along the ribs 5. Aluminium is a material that possesses extremely good heat-conductive properties, and as a consequence the heat will be transferred to the upper slab 7 owing to the direct contact of the latter with the beam frame 1 and through the ribs 5. The rest of the slab 7 is insulated from heat radiation by the layer 6 of mineral wool.

In practice, the result is that the refractory slab 4, when exposed to heat from underneath, will become very hot at its centre. At its edges, on the other hand, the heat will be transferred along the aluminium frame and conducted to the upper slab 7, which possesses the same good heat-transfer properties. However, this slab 7 is not exposed to direct heat but will be able to conduct the heat energy further from the beam frame 1 via radiation to the surrounding air. Also the parapet 8 will to some extent transfer heat away from the beam frame 1.

In addition to being heat-insulating, the layer 6 of mineral wool also possesses sound-proof properties and therefore eliminates any tendencies in the balcony platform to act as a resonance body.

Figure 3:
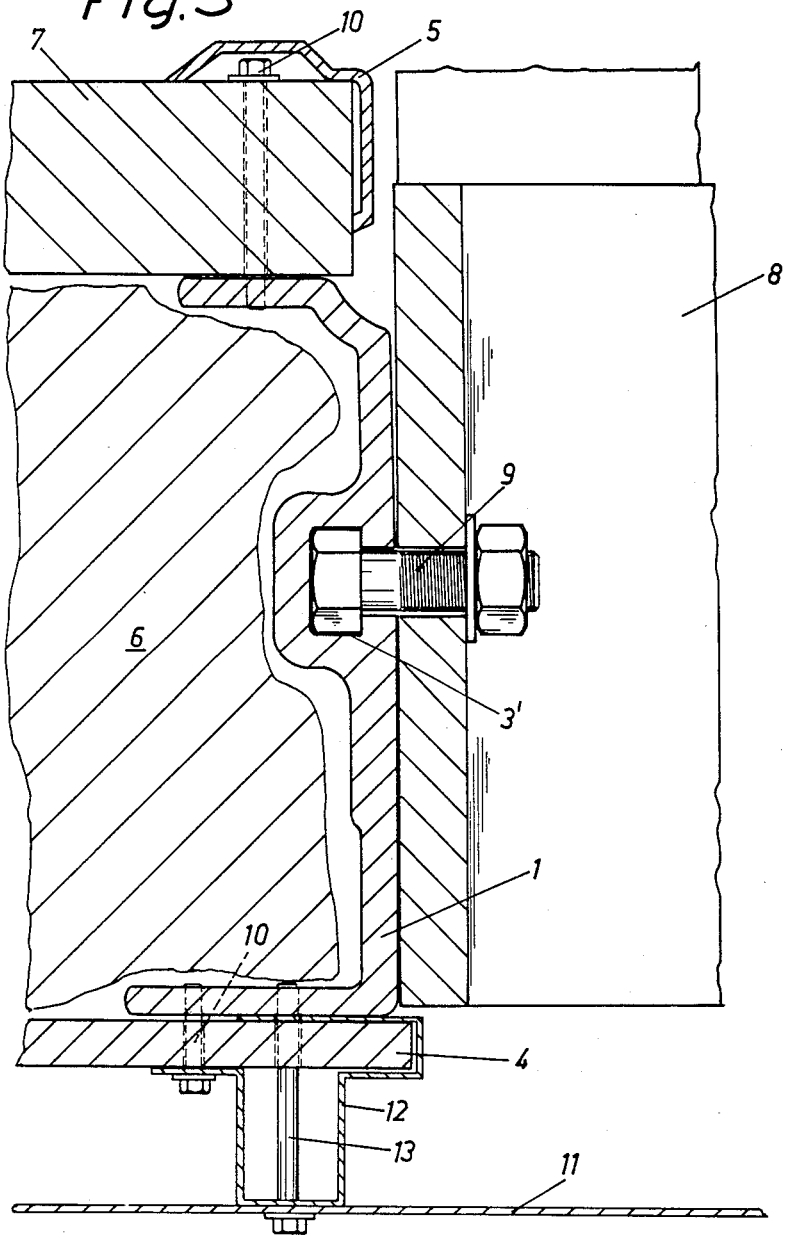
FIG. 3 illustrates on a still larger scale a cross-sectional view through an assembled balcony platform in accordance with a second embodiment of the invention.

FIG. 3 illustrates the balcony platform in accordance with a second embodiment according to which the profile of the beam frame 1 differs somewhat from that of the previous embodiment. Instead of having attachment apertures 3 the beams 1 are provided with an open front channel 3' into which bolts 9 may be inserted to secure the parapet 8. On the lower face of the bottom slab 4 and spaced somewhat therefrom is provided a steel panel 11 of a stainless material, the plate being secured to the slab through a spacer member 12 by means of a bolt 13 passing through the bottom slab and into the beam 1. An air gap of app. 20 millimeters thus will form between the bottom slab 4 and the seal panel 11.

To further improve the safety against the effects of fires the steel panel 11 is mounted in a special manner. More precisely, it is allowed to project somewhat beyond the balcony platform edges and in this manner it prevents flames from reaching the beam frame 1.

Figure 4:
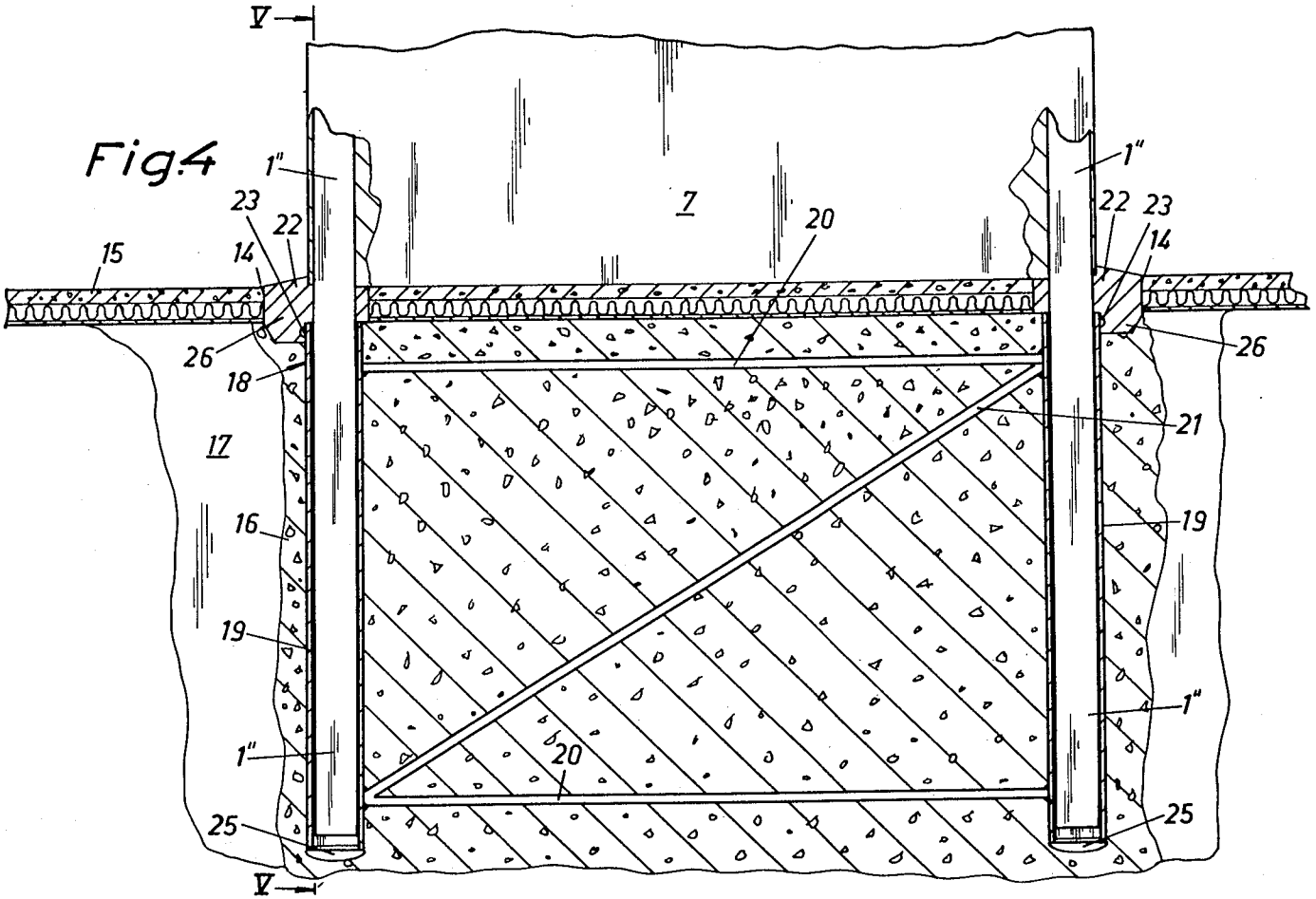
FIG. 4 is a view from above of a building floor including a balcony in accordance with the invention and using attachment members in accordance with a further embodiment.
Figure 5:
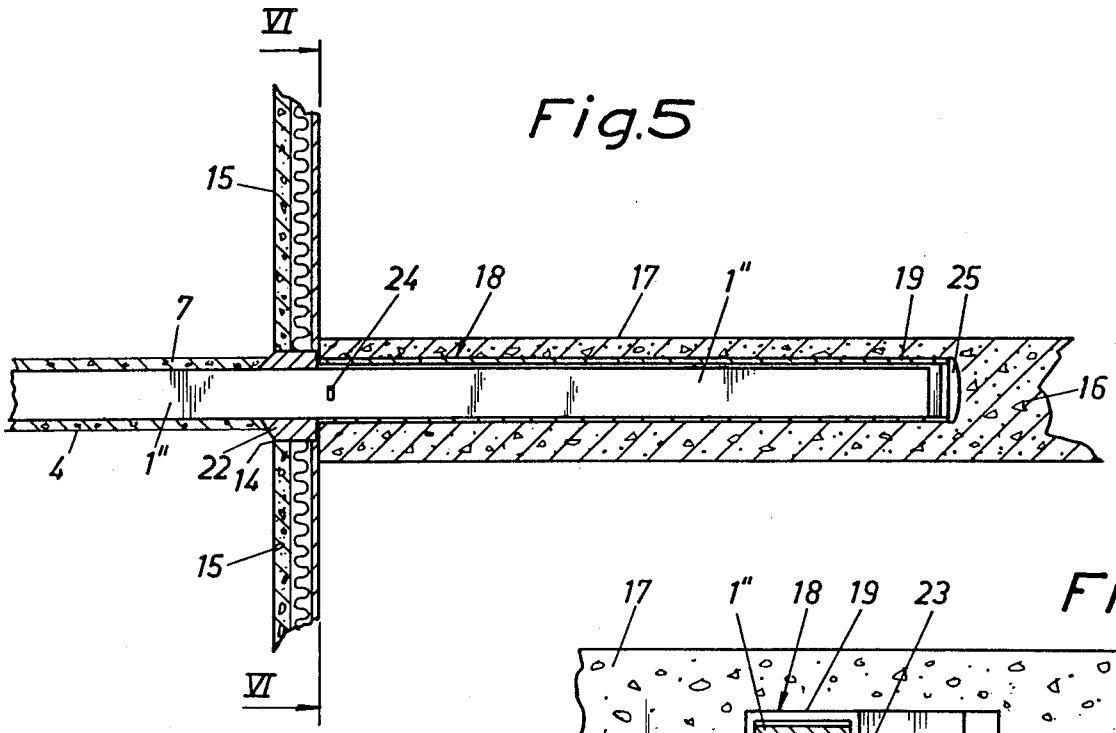
FIG. 5 is a sectional view through line V—V of FIG. 4.
Figure 6:
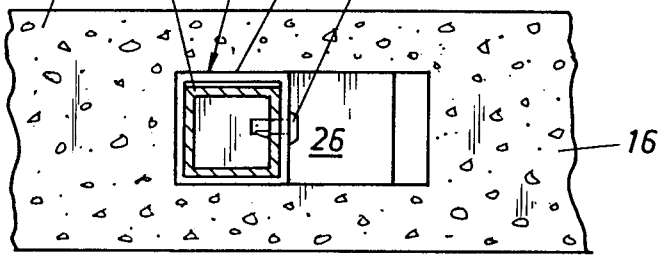
FIG. 6 is a sectional view along line VI—VI of FIG. 5.

In FIGS. 4–6 is shown an alternative method of securing the balcony platform in accordance with the invention to a building facade. Instead of securing it by means of bolts to the building wall the balcony platform is provided with prolonged supporting beams 1'' which project through apertures 14 formed in the building facade 15 and into the joists 16 of a building floor 17.

The two support beams 1'' are mounted in a fastening means 18 which is cast into the joists 16 and preferably is joined to the reinforcement members therein. The fastening means 18 consists of two parallel tube pieces 19 in which the support beams 1'' are inserted, and of two transverse stays 20 and one angular stay 21. The two transverse stays 20 and the angular stay 21 interconnect and position the two tube sections 19 relative to one another as regards spacing and parallelism.

The openings 14 formed in the building facade are filled with a substance 22 which forms a sealing bridge between the facade wall and the support beams. In the bottom of each opening 14 adjacent the joists 16 a locking pin 23 is inserted at right angles through the tube section 19 and the support beam 1'' in correspondingly shaped apertures 24 formed therein.

When a builing of concrete is constructed, the moulds are erected and the joists of each storey or floor are reinforced, the fastening means 18 being joined to the reinforcement irons and directed in the horizontal plane into a position at right angles to the facade 15. The openings of the tube sections 19 are still covered with plastics plugs 25 with which they preferably are provided in connection with the manufacture of the fastening means, these plastic plugs serving to prevent concrete from entering the tube section interior when the joists are being cast. Before the casting of the joists a block of suitable dimensions is attached to the mould wall immediately after the insertion of the locking pin 23. The purpose of the block is to form an indentation 26 in the joists 16, making it possible to enter the locking pin into and through the tube section.

When the casting of the joists 16 is completed, the mould sections including the blocks are removed and the facade wall 1 may be erected and attached to the joists. The openings 14 formed in the facade wall 15 are preferably covered by a cloth or a slab preventing moisture from entering, and the cloth or slab is not removed until the stage in the erection of the building is reached when the balconies are to be secured to the facade. At this point the covers on top of the openings 14 are removed and so are the plugs 25 covering the free ends of the tube sections. Each balcony is lifted to the desired level by a crane and the free ends of the support beams 1'' are guided into position inside the tube sections 19, whereupon the balcony is pushed inwards, towards and in contact with the facade 15. The locking pins 23 are then inserted via the indentations 26 and introduced into the apertures in the tube sections 19 to lock the support beams 1'' in position. Finally, the openings 14 in the facade wall 15 are filled with a sealing compound 22, such as expanding concrete, to provide adequate moisture sealing.

The design of the fastening means of the balcony platform to a facade as described and illustrated provides further resistance against the detrimental effects of fires. This is so because of the excellent properties of aluminium materials to conduct heat. The heat will be transferred via the beams into the joists, which have considerable resistance against heat. The design in accordance with the invention also makes the assembly and mounting of the balconies more simple and in addition allows such units to be attached and mounted at a comparatively late stage of the erection of the building.

The balcony in accordance with the invention is light, which is advantageous as it facilitates the handling of the balcony platform from its production stage up to the point when it is to be secured to the facade wall. In addition, the light weight makes it possible to make the attachment members for securing the balcony to the building wall smaller. The manufacturing costs of the balcony platform are comparatively low but the most important advantages gained by the balcony platform in accordance with the invention are that it does not require maintenance and that its serviceable lift is very long.

The invention is not limited to the embodiments described above and illustrated in the drawings but a number of modifications are possible within the scope of the appended claims. For instance, the bolts 9 may be drawn from the exterior directly into a threaded passageway formed in the beam frame 1. Also the bolts 10 may be secured in the beam frame proper.

What we claim is:

1. An improved prefabricated balcony platform adapted to be affixed to a building wall between vertically spaced windows or the like for assisting in the prevention of upward transmission of fire, said platform including attachment members for affixing said platform to the wall of a building, a parapet, and apertures in said platform to pass fastening means for securing said parapet to said balcony platform, the improvement comprising a load-supported generally open beam frame of a corrosion-resistant, heat conductive metal affixed to said attachment members, a bottom slab of refractory material detachably attached to the lower face of said beam frame and in heat transfer relation therewith, a top slab attached to the upper face of said beam frame in heat transfer relation thereto and consisting of a material having high heat-transfer properties, and an intermediate layer of sound-proof refractory material positioned in the opening of said beam frame and interposed between said top and bottom layers.

2. An improved prefabricated balcony platform as claimed in claim 1, comprising a first L-shaped edge rib fixed relative to said beam frame, said rib extending from an external face of said beam frame to the underneath face of said bottom slab so as to cover the edge of said slab, and a second similarly shaped edge rib affixed to each beam frame, said rib extending from an external face of said beam frame to the upperside face of said top slab so as to cover the edge of said top slab.

3. An improved prefabricated balcony platform as claimed in claim 1, wherein the top surface of said top slab is provided with an anti-slip surface.

4. An improved prefabricated platform as claimed in claim 1, comprising a fastening means positioned in the constructional parts of said building, said attachment members providing the means for fastening said balcony platform to said building, said fastening means comprising two parallel tube sections, stays fixed between and interconnecting said parallel tube sections and serving to maintain said tube sections in fixed interrelationship as regards their mutual spacings and angular positions, said fastening means arranged to be cast into the joists of said building at right angles to the facade thereof.

* * * * *